US005928473A

United States Patent [19]

Avila et al.

[11] Patent Number: 5,928,473

[45] Date of Patent: Jul. 27, 1999

[54] INHIBITION OF PHOTO-YELLOWING IN PAPER

[75] Inventors: David Victor Avila; Juan Cesar Scaiano, both of Ottawa, Canada

[73] Assignee: University of Ottawa, Ottawa, Canada

[21] Appl. No.: 08/783,269

[22] Filed: Jan. 15, 1997

[51] Int. Cl.[6] ..... D21H 17/06

[52] U.S. Cl. ..... 162/160; 162/158; 162/173; 162/135; 162/181.6; 162/181.8; 106/163.01

[58] Field of Search ..... 162/158, 160, 162/181.8, 181.6, 173, 135; 106/416, 163.01, 205.72

[56] References Cited

U.S. PATENT DOCUMENTS

| | | | |
|---|---|---|---|
| 2,132,724 | 10/1938 | Dalton . | |
| 2,249,188 | 7/1941 | De Witt . | |
| 2,924,549 | 2/1960 | Klein | 162/162 |
| 2,943,970 | 7/1960 | Allen | 162/181 |
| 3,607,621 | 9/1971 | Wasko et al. | 162/135 |
| 4,830,673 | 5/1989 | Jones et al. . | |
| 5,342,538 | 8/1994 | Chung et al. | 252/180 |
| 5,658,431 | 8/1997 | Janson et al. | 162/135 |

OTHER PUBLICATIONS

Smook, Handbook for Pulp & Paper Technologists, 2nd ed., Vancouver, B.C.: Angus Wilde Publications, p. 41, 1992.

Smook, Handbook of Pulp & Paper Terminology, Vancouver, B.C.: Angus Wilde Publications, p. 51, 1990.

Leary, G. L. Recent Progress in Understanding and Inhibiting the Light—Induced Yellowing of Mechanical Pulps, *J. Pulp Paper Sci.*, vol. 20(4), J154 –J160 (1994).

T. W. Greene and P. G. M. Wuts. Protective Groups In Organic Synthesis 2nd Ed.; J. Wiley and Sons, 1991, Chapter 4; 175–223.

*Primary Examiner*—Peter Chin
*Assistant Examiner*—Steven B. Leavitt
*Attorney, Agent, or Firm*—Woodcock Washburn Kurtz Mackiewicz & Norris LLP

[57] ABSTRACT

The present invention relates to a method for the inhibition of photo-yellowing in paper rich in lignin by treatment of pulp or paper rich in lignin with a compound containing hydroxy functionalities that are capable of forming a ketal with a carbonyl group in an acidic environment. In a preferred embodiment the acidic environment is provided by the presence of an acidic clay or an acidic zeolite.

23 Claims, 4 Drawing Sheets

INHIBITION OF PHOTO-YELLOWING IN PAPER

FIELD OF INVENTION

The present invention relates to a method for the inhibition of photo-yellowing in paper rich in lignin by treatment of pulp or paper rich in lignin.

BACKGROUND OF INVENTION

There are predominantly two types of paper produced, lignin-free paper and lignin-rich paper. Lignin-rich paper is inferior to lignin-free paper in that it is susceptible to photo- and thermal-degradation. When lignin-rich paper is exposed to light, for example sun-light or incandescent-light, the optical properties of the paper degrade rapidly. The most obvious effect is that the paper becomes "yellow" and is aesthetically unpleasing. For a review of photo-yellowing the reader is directed to: Leary, G. L. Recent Progress in Understanding and Inhibiting the Light-Induced Yellowing of Mechanical Pulps, *J. Pulp Paper Sci.,* Vol. 20(4), J154–J160 (1994), the disclosure of which is incorporated herein by reference.

The lignin present in pulp has a complex structure containing many functionalities. The structure of lignin varies depending upon the species of tree from which the pulp is obtained and also upon the environmental conditions under which the tree is grown. However, irrespective of the species of tree or conditions under which the tree is grown, lignin contains carbonyl functionalities and phenolic groups.

Lignin-rich paper, due to its inferior aging properties, is used for short-term usage, e.g., newspapers and telephone directories. Generally newsprint has a lignin content of about 25–35%. The advantages of lignin-rich paper are its cheapness, high-yield and ease of production. An example of lignin-rich paper is paper manufactured from thermomechanical pulp (TMP). Lignin-free paper is produced from chemically treated pulp. An example of lignin-free paper is that produced by the KRAFT process which involves the heating of pulp with a strongly basic aqueous solution.

A method of extending the lifetime (i.e., inhibiting the yellowing) of lignin-rich paper such as TMP paper would be of great value, as it would permit the use of lignin-rich paper in areas normally reserved for the more expensive lignin-free paper, e.g., in mid-term applications, such as forms which require a life extending from a few months to a few years. It is to this effect that the present invention is aimed.

The aforementioned article by Leary discusses many strategies that have been tried for inhibiting the light-induced yellowing of lignin-containing pulp and paper. Examples include:

i) reductive processes. Sodium borohydride treatment of lignin-rich paper, to transform carbonyl groups into the corresponding alcohols or hydroquinones, has been tried but without success. Reductive processes also have a detrimental effect on the mechanical properties of the paper produced;

ii) adding radical scavengers. This gives temporary protection to high-yield pulps but the scavengers are eventually consumed and yellowing resumes;

iii) acetylating or methylating lignin phenolic groups to prevent phenoxy radical formation. Acetylation can substantially retard yellowing. However, acetylation adversely affects the physical properties of the paper and it is not easy to acetylate lignin without also acetylating the cellulose present in the paper, which is undesirable because it reduces the hydrogen bonding that holds the fibers together in the paper.

An understanding of paper making is an advantage in understanding the present invention and where best to apply the present invention. A typical modern paper machine begins with a flow spreader or distributor, conveying a dilute aqueous fiber suspension (0.1–1% fibers) to a headbox which delivers a jet of the suspension or slurry through a sluice across the full width of the machine, which may be almost 10 meters in width in some large machines. In the headbox, the fibers are dispersed and the flow rate adjusted as well as possible so that the jet is delivered onto a moving endless fine-mesh wire screen with uniform composition, flow rate and velocity, to generate a travelling paper web. The pressure in the headbox and its sluice opening are adjusted so that the jet velocity matches the speed of the wire screen, which may be up to 1220 meters.minute$^{-1}$ for newsprint. The proper stock flow per unit width corresponds to the desired weight of pulp per unit area.

A large proportion of water is removed from the paper web by a series dewatering steps, for example using rolls, foils and vacuum boxes. The formed paper sheet after these dewatering steps contains about four to five parts water to one part solids and is subjected to a felt press, which is a fine-textured, usually synthetic, fabric. The wet paper web that is formed is then passed with one or more press felts through two or more press-roll nips, where water is squeezed out and the paper mat is compacted. After the paper web has been subjected to mechanical removal of water most of the remaining water, down to 5–10%, must be removed by evaporative processes. These evaporative processes may include, for example, passing the paper through heated rollers, use of ventilating devices which blow air of a controlled temperature and humidity, or use of radiant heating, dielectric or microwave heating.

It is an object of the invention to provide a process that inhibits the yellowing of lignin-containing paper, which process is acceptable for use in the pulp and paper industry. Hence, the process should be a) cheap b) facile c) non-toxic in the plant d) non-toxic in the product and e) not result in paper with inadequate mechanical properties.

SUMMARY OF INVENTION

The present invention provides a process for increasing the photostability of paper made from lignin-containing pulp, which process comprises treating the pulp or paper with a diol that is capable of forming a ketal with a carbonyl group in an acidic environment.

Preferably the acidic environment is provided by a clay or a zeolite. The acidity of an acidic clay/zeolite is conferred by acidic sites on the surface of the clay and additionally within a zeolite. A mixture of clay/zeolite, pulp and diol is a heterogeneous mixture. Hence, the acidity that the clay/zeolite confers on the mixture cannot be expressed as unity or in the usual terms of pH.

It is known to use clays in the manufacture of paper to improve the mechanical properties of the paper. Clay is used as a filler in paper and is also used for changing the surface qualities of paper to improve the printability of paper. A commonly used clay in the pulp and paper industry is kaolin. The terms clay and zeolite encompass both naturally occurring and synthetically obtained materials. Clays have a layer type structure and are generally fine and are hydrated aluminum silicates. Zeolites are porous and encompass molecular sieves and are hydrated silicates of aluminum and either sodium or calcium. Clays or zeolites used in the process of the invention may have been subjected to ion exchange reactions, i.e., they may have had their associated counterions replaced by other ions e.g., magnesium, potassium or ammonium ions. The paper industry already makes use of clay in some grades of paper and when the invention is applied to those grades of paper a diol application step can be introduced to the known paper making process, the normally added clay serving to provide the required acidic environment. Clays that are presently in common use in papermaking include kaolin and hydrex.

Examples of clays and zeolites that can be used in the process of the invention include kaolin, montmorillonite, hydrex, laponite, hectorite, saponite, nontronite, sauconite, attapulite, illite, benolite, halloysite, analcite, chabazite, heulandite, natrolite, stilbite and thomsonite and molecular sieves. In a preferred embodiment of the invention, the clay is kaolin or montmorillonite. At the present time the most cost effective clays are those that are mined. The mined clays may have been subjected to known steps in order to improve their brightness and other optical qualities before being used in the present invention.

Of course, the clay/zeolite should be in the form of fine powder, preferably a substantially uniform fine powder. The smaller the average diameter of the clay/zeolite particles the larger the surface area that will be available per unit mass of clay/zeolite. The greater the surface area of clay/zeolite available to the paper/diol the more efficient will be the treatment. The average diameter of the clay/zeolite particles should be commensurate with the quality of the finished paper product. It is preferred that the clay/zeolite particles be small enough so as to not adversely affect the smoothness of the finished paper product. It is preferred that the average particle size of the clay/zeolite is in the range of about 50 $\mu$m to 1 $\mu$m, preferably about 25 $\mu$m to 1 $\mu$m and most preferably below about 10 $\mu$m.

The diol that is used in the process of this invention has a molecule that contains at least two hydroxy functionalities (dihydroxy moiety) that can form a ketal with a carbonyl group. The diol may have more than two hydroxy functionalities, provided that it has two hydroxy groups located so that they are able to react with a carbonyl group to form a ketal. Hence, 1,2-diols, 1,3-diols and 1,4-diols are preferred. 1,3-Diols are particularly preferred. In organic chemistry, it is well known to convert carbonyl moieties into ketals. This can be achieved by reaction of a carbonyl moiety with a suitable diol in the presence of a catalytic amount of acid and is effected by dehydration of the reaction mixture. For a review of the formation of ketals from ketones and aldehydes the reader is directed to: T. W. Green and P. G. M. Wuts. Protective Groups In Organic Synthesis 2nd Ed.; J. Wiley and Sons, 1991, the disclosure of which is incorporated herein by reference. The molecule of the diol may also have functional groups other than the hydroxy groups, provided that they do not interfere with the ketal-forming reaction and are not otherwise objectionable in paper. Examples of such groups include mercapto groups and moieties of high reactivity towards free radicals.

Relatively small diol molecules, i.e., with a molecular weight greater than 76 but below about 1000, are preferred. It is particularly preferred that the diol has a molecular weight below about 500, especially below about 250. The relatively small molecules are more effective in this heterogeneous reaction as they are able to diffuse readily about the clay/zeolite or paper and interact with the clay/zeolite and the carbonyl functionalities of lignin. However, in the case of a diol containing a thioalcohol or thiophenol functionality the molecular weight of the diol must be such that the diol containing a thioalcohol or thiophenol has a low vapour pressure. That is, one should not be able to smell the characteristic smell of these sulphur compounds in the treated paper.

Preferred embodiments of the invention employ diols such as, 1,2-diols and 1,3-diols, for example, 1,2-ethylene glycol, neopentyl glycol, 1,3-propanediol, thioglycerols, sugars, e.g., monosaccharides such as glucose, fructose, and mannose, and disaccharides such as sucrose. Of particular preference are 1,2-ethylene glycol and neopentyl glycol.

In the process of the invention the diol can be applied to pulp, or it can be applied to paper. In the description of the invention there is no precise point at which the transition from pulp to paper is considered to occur. In the following description, therefore references to the addition of diol to "pulp" should be understood to apply equally to the addition of diol to "paper", and vice versa, unless the context requires otherwise.

The method by which the diol is added to the pulp or clay/zeolite is not at the essence of the invention and any convenient and effective method can be used. The diol may be added to a mixture of pulp and clay or zeolite. The diol may be admixed with clay or zeolite and this mixture applied to the pulp. Possible, although less preferred, is the admixture of the diol with pulp before clay or zeolite is added to the pulp/diol mixture. Diols are generally viscous liquids or solid materials under ambient conditions. For example, neopentyl glycol [2,2-dimethyl-1,3-propanediol, $HOCH_2C(CH_3)_2CH_2OH$] is a hygroscopic solid, m.p. 123–127° C., and 1,2-ethylene glycol ($HOCH_2CH_2OH$) is a hygroscopic viscous liquid whose viscosity is 19.9 centipoise at 20° C. The diol will usually be in the form of a liquid and can be applied in any suitable manner. Consequently, the diol may be added in an aqueous or alcoholic solution, e.g., methanolic or ethanolic solution. For instance, the diol may be sprayed onto the pulp. In another embodiment the pulp may be led through a bath containing the diol. In another embodiment the pulp may be "printed" with the diol, by contact with a roller whose surface is maintained in contact with the diol. Application by spraying or by printing may be to one or both surfaces of a paper sheet. In yet another embodiment diols that are solid or viscous at room temperature can be heated and applied in the vapour phase, although this may not be preferred.

Preferably an aqueous solution of the diol is applied in the form of a spray to a mixture of paper and clay or zeolite.

During the manufacture of paper, the paper may exit the manufacturing process at a relatively high temperature (below about 100° C.) which aids the ketalization process. However, the heating of the paper/clay or zeolite/diol mixture is not essential to the invention.

As stated above, TMP pulp is lignin-rich and may contain up to about 35% by weight of lignin. KRAFT paper is substantially or completely lignin-free. It is of course possible to mix lignin-rich pulp, e.g., TMP pulp, with lignin-free pulp, e.g., KRAFT pulp, in any amount, to obtain a pulp whose lignin content is anywhere greater than 0 and less than about 35%.

The reaction between a carbonyl moiety and a diol is an acid-catalysed condensation that results in elimination of water. The reaction is an equilibrium reaction that is favoured by removal of water from the reaction mixture. In the presence of large quantities of water there will be formed little, if any, ketal, and as water is removed from the pulp some diol may go with the water and be lost to the process. Hence, it is preferred to add the diol towards the end of the paper-making process, when the amount of water has been reduced. For the same reason it is preferred that if the diol is supplied in solution a fairly concentrated solution is used, provided that there is present sufficient water to ensure good dispersion of the diol. It is preferred that the diol is added to paper when the paper has a water content of less than about 50% wt/wt, especially less than about 25%, most especially less than about 20%. It is preferred that the diol is added in an aqueous solution comprising at least about 10% wt/wt preferably at least 20%, more preferably at least 30% diol by weight of the solution.

The greater the content of lignin in paper/pulp the greater the amount of diol and acidic material required. Conversely, the lower the amount of lignin present in the paper/pulp the smaller the amount of diol and acidic material required. Ideally the amount of diol should be sufficient to convert every carbonyl moiety in the lignin into a ketal, i.e., one molar equivalent of dihydroxy units per carbonyl functionality. However, in practice it may be necessary to add an excess of diol. The inventors estimate that, with a diol having a molecular weight under 250, satisfactory results are obtained by addition of approximately 9% by weight of diol, based on the weight of lignin present in the paper. This corresponds to 3% by weight of diol, based on weight of TMP paper. It is a matter of routine experimentation, requiring no inventive faculty, to determine the optimum concentration of a diol for photoresistance. A paper sample containing a zeolite or clay may be treated with differing amounts of a specific diol and subjected to accelerated photoaging tests, as detailed in the experimental section of this specification, or subjected to ambient photoaging tests. A comparison of the optical properties of the treated papers after irradiation should lead to the required concentration of the diol.

In a preferred embodiment of the invention, the clay is present in about 5–25% by weight of the lignin-rich pulp and the diol is present in about 3–15 % by weight of lignin-rich pulp. For example, a mixture comprising a pulp with a 30% lignin content and 15% clay/zeolite may be treated with approximately 150 $cm^3$ of a 20% by weight aqueous neopentyl glycol solution per kilogram dry weight of the pulp.

It is also within the scope of the present invention for lignin-containing paper to be treated on only one or on both surfaces with a clay or zeolite and a suitable diol. If the invention is worked in this mode, in a preferred embodiment of the invention, the clay is present in about 0.1–5% by weight of the paper and the diol is present in about 1–15% by weight of the pulp.

The pulp or paper may contain other additives that are commonly used in paper-making. For example, pigments such as titanium dioxide, fillers such as precipitated calcium carbonate and cationic retention aids such as aluminum sulphate may be present.

The invention is exemplified by the following non-limiting examples.

Experimental

General preparation of handsheet paper samples

Figure 1:
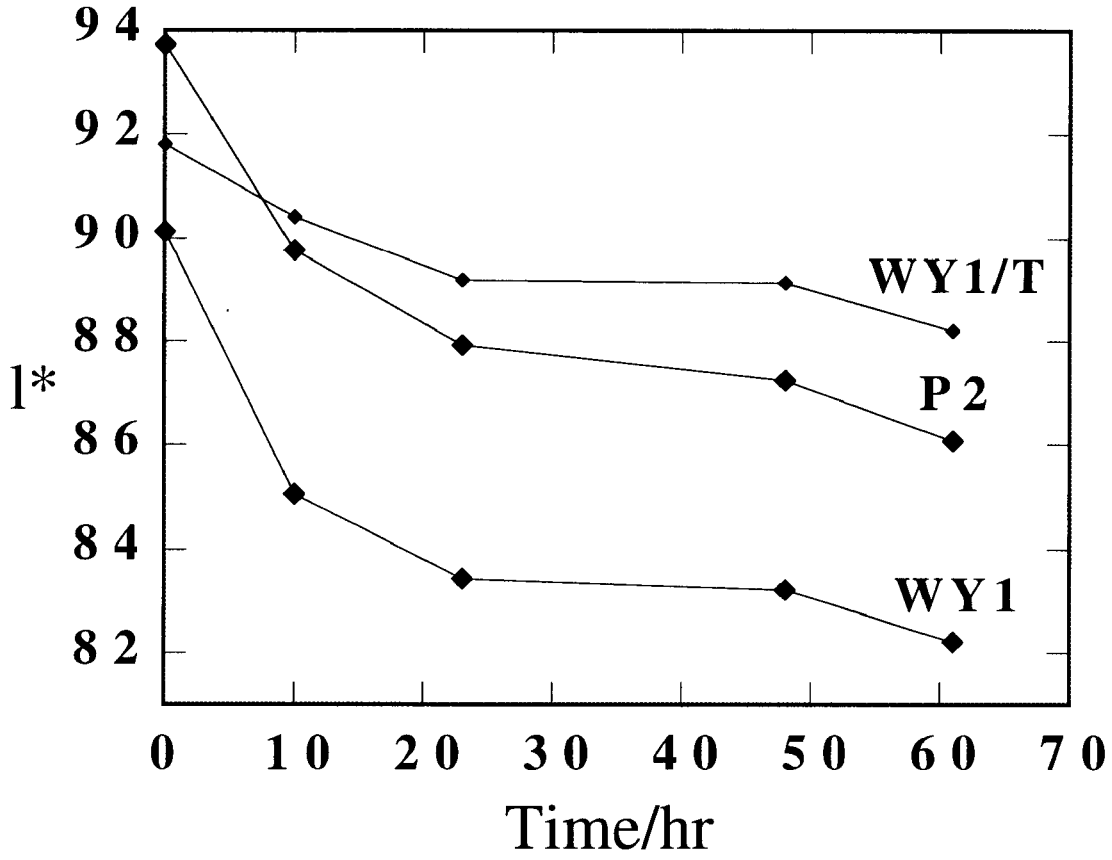
FIG. 1 illustrates the change in reflectivity (l*), as a function of irradiation time, of (a) paper containing natural mined Wyoming montmorillonite (WYl), (b) paper containing natural mined Wyoming montmorillonite that has been treated with neopentyl glycol (WYl/T) and (c) a control sample of paper (P2) which does not contain either a clay or zeolite.

Bleached Spruce pulp (4 g, dry weight) was added to water (0.5 1) containing 0.1% of aluminum sulphate [$Al_2(SO_3)_3$] and stirred vigorously. After approximately 2 minutes of stirring a clay (0.8 g) was added, followed by stirring for a further 5 minutes to form a slurry. A handsheet paper sample was then made from the slurry by filtering the slurry on standard industrial paper-making equipment and pressing the resulting filtered material. The hand sheet was subsequently air dried at room temperature. By increasing the amount of clay added in the preparation of the handsheet a greater concentration of clay was incorporated into the handsheet. Control paper samples were prepared in the same manner as in the general preparation of hand sheets, except that no clay was added. Some of the clay-free control samples contained aluminum sulphate and some did not.

Application of a diol to the air dried handsheet

The air dried hand sheet was weighed and treated evenly with a volume of methanol/diol solution such that the amount of diol applied to the paper was approximately 3% by weight of the total air dried handsheet.

The approximate concentration of the clay in the paper was determined from the ash content of the paper.

In accelerated aging tests the paper samples were irradiated with a series of 350 nm, 8 Watt Rayonet lamps (obtained from the the Southern New England Ultraviolet Company) at a standard distance (ca. 15 cm) from the paper, for consistency of comparison.

The results are given in terms of Iso (also known as R), l* and b* which are industrial standards of measurement for the optical properties of paper. Iso (R) is a measure of the absolute reflectance, b* is a measure of the yellow tint and l* is a measure of the loss in reflectivity. High Iso (R) and l* values are desirable in white paper and a low b* value is desirable in white paper. The higher the b* value the more yellow the appearance of the paper.

EXAMPLES

Example 1

α-Guaiacylacetoveratrone (α-GAV), which contains a carbonyl functionality, is considered to be a model compound for study of the photochemistry of lignin, as noted in the aforementioned Leary reference and references contained therein. It is known from product studies and laser flash experiments that α-GAV absorbs light, and fragments to yield the 2-methoxyphenoxy radical and the 3,4-dimethoxyphenacyl radical. Time resolved laser flash experiments on α-GAV have shown that the 2-methoxyphenoxy radical has an absorption at 380 and 660 nm [For a description of time-resolved laser flash photolysis the reader is directed to Paul, H.; Small, R. D. Jr.; Scaiano, J. C. *J. Am. Chem. Soc.* 1978, 100, 4520–4527 and Kazanis, S.; Azarani, A.; Johnston, L. J. *J. Phys. Chem.* 1991, 95, 4430–4435, all of which are incorporated herein by reference]. The 1,2-ethyleneglycol ketal of α-GAV is readily prepared by azeotropic dehydration of a mixture of α-GAV and 1,2-ethyleneglycol in the presence of a catalytic amount of p-toluene sulphonic acid.

In contrast, the 2-methoxyphenoxy radical was not detected when an acetonitrile solution of the 1,2-ethyleneglycol ketal of α-GAV was subjected to nanosecond time resolved laser flash photolysis at 308 nm. This experiment indicates that removal of the carbonyl functionality of α-GAV by ketalization prevents the photo-induced fragmentation of α-GAV.

Example 2

The following is a comparison between paper made from pulp with additives. Sample MO4 contains montmorillonite [montmorillonite K 10 (Aldrich™)], sample Ca6 contains calcium carbonate, sample AA6 contains acidic alumina, sample MS5 contains molecular sieves [molecular sieves 13X, powder 2μ (Aldrich™)], sample BA5 contains basic alumina, sample XF4 contains a mined kaolin that is used in the pulp and paper industry, sample EEC4 contains a mined kaolin that is used in the pulp and paper industry and sample KA4 contains a kaolin that is available from Aldrich™. The aforementioned samples are compared to a control sample of paper (A5) containing no additive. All the paper samples containing additives and the control sample (A5) have been treated with a cationic retention aid aluminium sulphate. In the following results the suffix /T beside a sample identifier indicates that the paper sample had been treated with neopentyl glycol, using approximately 3 parts by weight of neopentyl glycol per 100 parts by weight of the paper sample.

The ash contents of the paper samples were as follows: (MO4) 11.8%, (Ca6) 12.1%, (AA6) 16.7%, (MS5) 10.5%, (BA5) 16.3%, (XF4) 29.6%, (EEC4) 9.33, (KA5) 10.7% and (5A) 0.76%, from which it is estimated that actual additive content of (MO4), (Ca6), (AA6), (MS5), (BA5), (XF4), (EEC4) and (KA5) are 11.1%, 11.3%, 16.0%, 9.7%, 15.5%, 28.8%, 8.6% and 10.0% , respectively.

Tables 1, 2 and 3 show how the numerical values Iso (R), b* and l* of the paper samples vary with irradiation time when irradiated at 350 nm. Consistently throughout these tables it is seen that those samples treated with "diol" are more resistant to photodegradation of their optical properties. A comparison of the changes in the values Iso (R), b* and l* of the paper samples with irradiation time shows consistently that the samples treated with neopentyl glycol are the most resistant to photodegradation. The combination of treatment with montmorillonite and neopentyl glycol is the most effective.

TABLE 1

| (see example 2) | | | | | | |
|---|---|---|---|---|---|---|
| (Diol Added) | | | (No Diol Added) | | | Irradiation |
| Iso | l* | b* | Iso | l* | b* | Time/hr |
| 5A/T | | | 5A | | | |
| 75.69 | 94.99 | 10.04 | 73.36 | 93.94 | 10.16 | 0 |
| 55.87 | 90.00 | 18.82 | 54.77 | 90.28 | 20.34 | 4 |
| 51.83 | 89.61 | 22.51 | 51.31 | 89.09 | 21.89 | 9 |
| 49.87 | 89.43 | 24.29 | 46.35 | 88.07 | 25.79 | 24 |
| 43.05 | 87.72 | 28.92 | 37.39 | 85.69 | 32.44 | 57 |
| XF4/T | | | XF4 | | | |
| 65.48 | 91.63 | 12.60 | 67.35 | 92.20 | 11.96 | 0 |
| 59.38 | 90.40 | 16.11 | 57.93 | 89.72 | 16.30 | 4 |
| — | — | — | — | — | — | 9 |
| 54.81 | 89.81 | 19.72 | 49.85 | 88.53 | 22.72 | 24 |
| 48.83 | 86.23 | 27.57 | 41.82 | 86.23 | 27.57 | 57 |
| MO4/T | | | MO4 | | | |
| 56.55 | 87.15 | 13.13 | 55.07 | 84.64 | 10.25 | 0 |
| 52.31 | 85.97 | 15.37 | 47.70 | 83.21 | 15.46 | 4 |
| 50.00 | 85.32 | 16.77 | 45.01 | 82.50 | 17.31 | 9 |
| 47.56 | 85.06 | 19.12 | 41.68 | 82.69 | 21.76 | 24 |
| 44.77 | 84.80 | 21.81 | 36.89 | 81.44 | 25.50 | 57 |

TABLE 2

| (see example 2) | | | | | | |
|---|---|---|---|---|---|---|
| (Diol Added) | | | (No diol added) | | | Irradiation |
| Iso | l* | b* | Iso | l* | b* | Time/hr |
| BA5/T | | | BA5 | | | |
| 65.28 | 92.04 | 13.54 | 66.36 | 92.55 | 13.55 | 0 |
| 59.14 | 90.71 | 16.90 | 55.49 | 89.94 | 19.10 | 4 |
| 56.87 | 90.34 | 18.52 | 51.83 | 89.00 | 21.24 | 9 |
| 52.48 | 89.67 | 21.94 | 46.91 | 88.27 | 25.48 | 24 |
| 49.62 | 89.17 | 24.09 | 41.56 | 86.85 | 29.17 | 57 |
| EEC4/T | | | EEC4 | | | |
| 62.06 | 91.00 | 14.63 | 66.12 | 92.40 | 13.48 | 0 |
| 57.56 | 90.14 | 17.41 | 56.49 | 90.02 | 18.27 | 4 |
| 54.16 | 89.46 | 19.67 | 51.41 | 88.84 | 21.42 | 9 |
| 52.48 | 89.67 | 21.65 | 47.04 | 88.11 | 25.07 | 24 |
| 47.53 | 88.22 | 24.69 | 40.29 | 86.30 | 29.31 | 57 |
| KA5/T | | | KA5 | | | |
| 62.01 | 90.87 | 14.45 | 67.18 | 92.66 | 13.01 | 0 |
| 56.73 | 89.84 | 17.74 | 56.15 | 90.01 | 18.59 | 4 |
| 54.74 | 89.49 | 19.00 | 53.47 | 89.48 | 20.42 | 9 |
| 51.86 | 89.04 | 21.45 | 47.46 | 88.41 | 25.13 | 24 |
| 48.38 | 88.43 | 24.13 | 41.81 | 86.97 | 29.05 | 57 |

TABLE 3

| (see example 2) | | | | | | |
|---|---|---|---|---|---|---|
| (Diol Added) | | | (No Diol Added) | | | Irradiation |
| Iso | l* | b* | Iso | l* | b* | Time/hr |
| Ca6/T | | | Ca6 | | | |
| 63.09 | 91.80 | 15.15 | 68.14 | 93.09 | 12.96 | 0 |
| 57.33 | 90.38 | 18.16 | 58.57 | 90.93 | 17.86 | 4 |
| 54.18 | 89.74 | 20.14 | 54.00 | 89.79 | 20.45 | 9 |
| 51.07 | 89.07 | 22.35 | 49.67 | 88.82 | 23.42 | 24 |
| 47.93 | 88.29 | 24.33 | 43.06 | 87.08 | 27.75 | 57 |

TABLE 3-continued

| (see example 2) | | | | | | |
|---|---|---|---|---|---|---|
| (Diol Added) | | | (No Diol Added) | | | Irradiation |
| Iso | l* | b* | Iso | l* | b* | Time/hr |
| AA6/T | | | AA6 | | | |
| 62.93 | 91.44 | 14.64 | 65.57 | 92.48 | 14.15 | 0 |
| 57.41 | 90.29 | 17.85 | 55.03 | 89.74 | 19.21 | 4 |
| 54.15 | 89.58 | 19.91 | 50.69 | 88.52 | 21.66 | 9 |
| 51.18 | 89.18 | 22.42 | 46.42 | 87.97 | 25.49 | 24 |
| 46.87 | 88.38 | 25.70 | 39.49 | 85.84 | 29.84 | 57 |
| MS5/T | | | MS5 | | | |
| 67.12 | 92.83 | 13.26 | 67.96 | 93.13 | 13.12 | 0 |
| 60.64 | 91.36 | 16.62 | 58.14 | 90.79 | 17.96 | 4 |
| 58.82 | 91.16 | 18.01 | 54.02 | 89.94 | 20.62 | 9 |
| 49.45 | 89.04 | 24.01 | 54.27 | 90.31 | 21.19 | 24 |
| 50.95 | 89.80 | 23.72 | 42.37 | 87.29 | 28.96 | 57 |

Example 3

The following is a comparison between paper samples made from pulp with three types of montmorillonite, a natural mined Wyoming montmorillonite (WYl), a natural mined Texan montmorillonite (NT3) and a synthetic (SYl) montmorillonite, against control samples of paper (P1 and P2) made from the same pulp as the paper, but free of montmorillonite. Some of the paper samples were also treated with neopentyl glycol. All the papers containing clay had been treated with a cationic retention aid, aluminum sulphate. However, only one of the clay-free paper samples, P1, had been treated with aluminum sulphate.

The ash contents of the paper samples were as follows: (WYl) 19.3%; (NT3) 14.0%; (SYl) 18.0%; ( P1) 1.11% and (P2) 1.10%, from which it is estimated that actual clay content of (WYl), (NT3) and (SYl) are 18.2%, 12.9% and 16.9%, respectively. In the following results the suffix /T beside a sample identifier indicates that the paper sample had been treated with neopentyl glycol; approximately 3 parts by weight of neopentyl glycol per 100 parts by weight of the paper sample.

Table 4 and Table 5 show how the numerical values Iso (R), b* and l* of the paper samples vary with irradiation (350 nm) time. Consistently throughout these tables it is seen that those samples treated with diol are more resistant to photodegradation of their optical properties. A comparison of the data shows that natural montmorillonites are more effective than the synthetic montmorillonite in the photostabilization of paper. The natural montmorillonites are cheaper than the synthetic montmorillonite and TMP.

TABLE 4

| (see example 3) | | | | | | |
|---|---|---|---|---|---|---|
| (Diol Added) | | | (No Diol Added) | | | Irradiation |
| Iso | l* | b* | Iso | l* | b* | Time/hr |
| WY1/T | | | WY1 | | | |
| 69.47 | 91.81 | 9.50 | 68.01 | 90.14 | 7.64 | 0 |
| 59.88 | 90.41 | 15.77 | 50.58 | 85.05 | 15.64 | 10 |
| 54.61 | 89.18 | 18.18 | 44.68 | 83.43 | 19.55 | 23 |
| 52.36 | 89.13 | 21.04 | 41.56 | 83.21 | 22.69 | 48 |
| 49.67 | 88.21 | 22.18 | 38.81 | 82.22 | 24.35 | 61 |

TABLE 4-continued

| (see example 3) | | | | | | |
|---|---|---|---|---|---|---|
| (Diol Added) | | | (No Diol Added) | | | Irradiation |
| Iso | l* | b* | Iso | l* | b* | Time/hr |
| SY1/T | | | SY1 | | | |
| 72.04 | 93.75 | 10.86 | 71.53 | 93.17 | 9.91 | 0 |
| 60.01 | 91.93 | 18.33 | 54.70 | 90.03 | 20.23 | 10 |
| 54.35 | 90.48 | 21.38 | 47.66 | 88.20 | 24.42 | 23 |
| 50.30 | 89.96 | 24.68 | 43.66 | 87.64 | 27.99 | 48 |
| 47.63 | 89.08 | 25.95 | 40.04 | 86.23 | 29.96 | 61 |
| NT3/T | | | NT3 | | | |
| 72.35 | 93.75 | 10.46 | 69.38 | 91.88 | 9.63 | 0 |
| 61.27 | 92.07 | 17.39 | 55.62 | 89.77 | 18.79 | 10 |
| 55.77 | 90.75 | 20.23 | 48.89 | 88.13 | 23.03 | 23 |
| 52.71 | 90.42 | 22.91 | 45.12 | 87.54 | 26.09 | 48 |
| 50.25 | 89.62 | 24.05 | 41.89 | 86.38 | 27.77 | 61 |

TABLE 5

| (see example 3) | | | | | | |
|---|---|---|---|---|---|---|
| (Diol Added) | | | (No Diol Added) | | | Irradiation |
| Iso | l* | b* | Iso | l* | b* | Time/hr |
| P1/T | | | P1 | | | |
| 71.43 | 93.96 | 10.32 | 71.85 | 93.91 | 10.95 | 0 |
| 59.36 | 91.70 | 18.51 | 56.37 | 90.78 | 19.81 | 10 |
| 53.13 | 89.96 | 21.70 | 49.59 | 88.78 | 23.45 | 23 |
| 50.54 | 89.85 | 24.20 | 45.06 | 88.02 | 26.99 | 48 |
| 47.74 | 88.74 | 25.42 | 41.62 | 86.74 | 28.81 | 61 |
| P2/T | | | P2 | | | |
| 71.86 | 93.36 | 10.46 | 72.20 | 93.73 | 10.34 | 0 |
| 57.58 | 91.00 | 18.96 | 53.85 | 89.76 | 20.52 | 10 |
| 51.81 | 89.43 | 22.09 | 47.23 | 87.93 | 24.49 | 23 |
| 49.62 | 89.53 | 24.63 | 42.88 | 87.24 | 28.20 | 48 |
| 47.23 | 88.75 | 25.81 | 39.70 | 86.06 | 29.96 | 61 |

Figure 2:
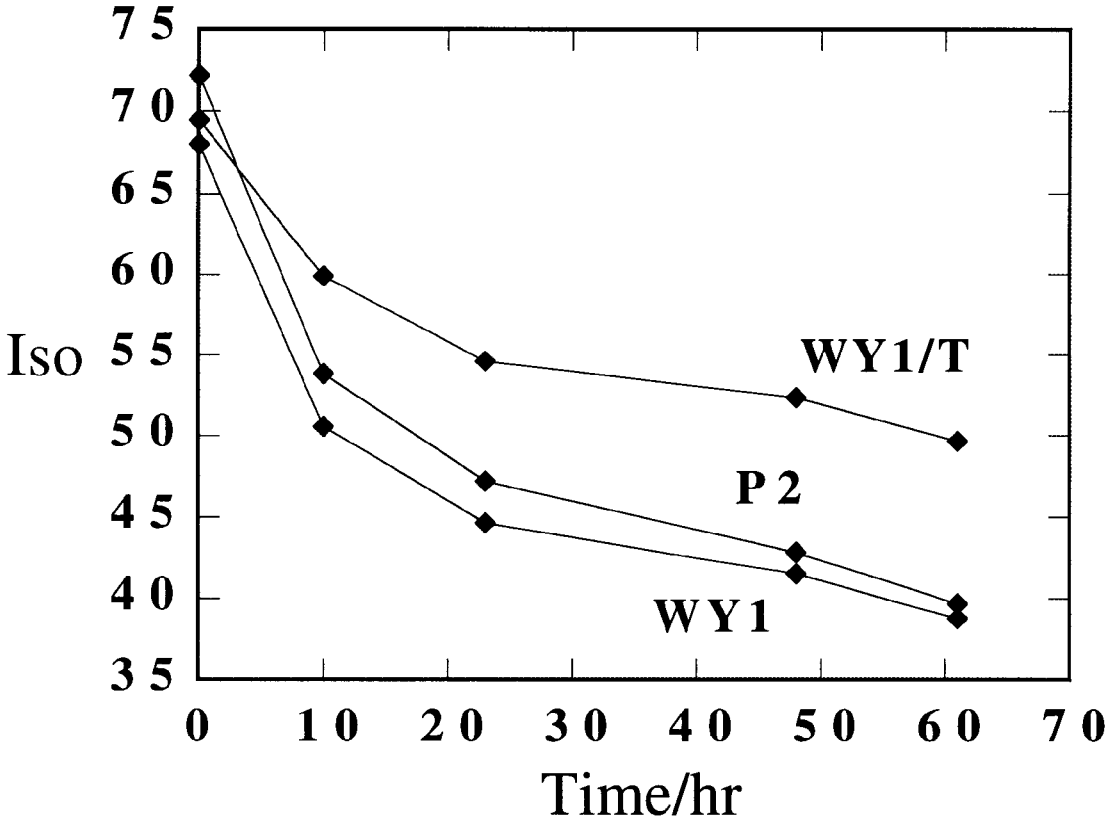
FIG. 2 illustrates the change in absolute reflectance [Iso (R)], as a function of irradiation time, of (a) paper containing natural mined Wyoming montmorillonite (WYl), (b) paper containing natural mined Wyoming montmorillonite that has been treated with neopentyl glycol (WYl/T) and (c) a control sample of paper (P2) which does not contain either a clay or zeolite.
Figure 3:
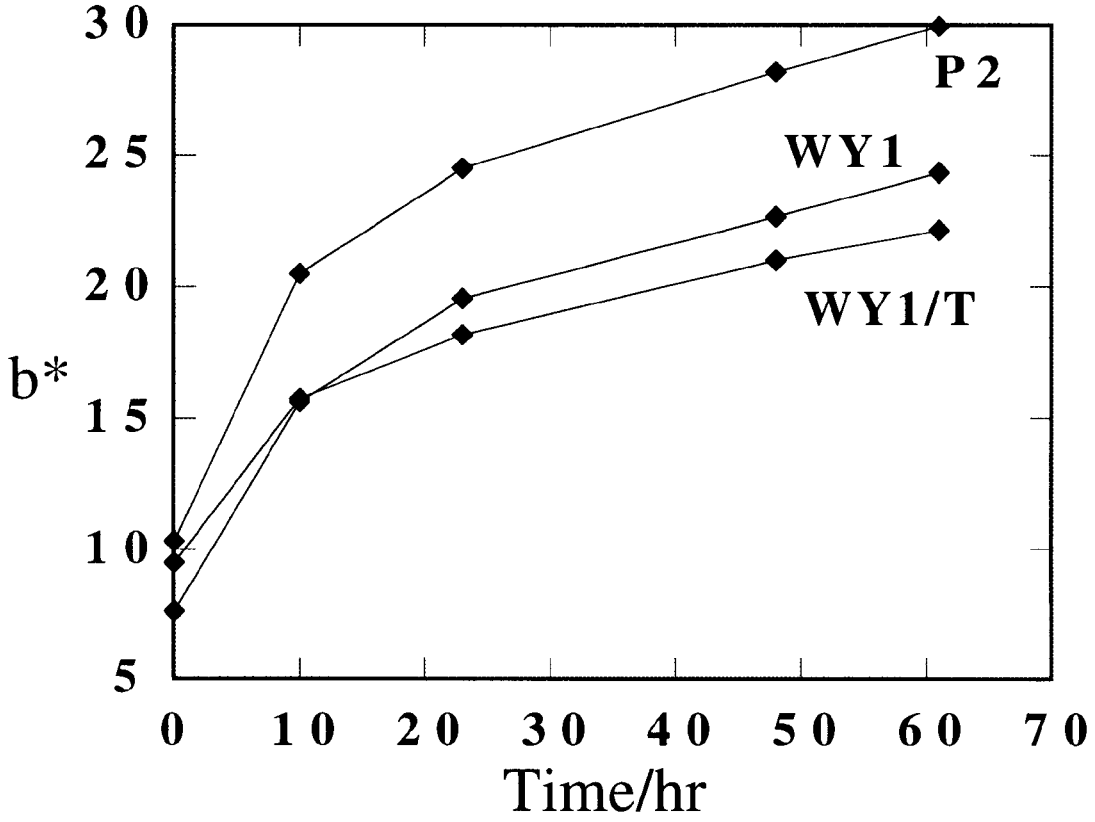
FIG. 3 illustrates the change in yellow tint (b*), as a function of irradiation time, of (a) paper containing natural mined Wyoming montmorillonite (WYl), (b) paper containing natural mined Wyoming montmorillonite that has been treated with neopentyl glycol (WYI/T) and (c) a control sample of paper (P2 ) which does not contain either a clay or zeolite.

FIGS. 1, 2 and 3 show a comparison of the optical properties, l*, Iso (R), and b* respectively, of samples WYl/T, P2 and WYl as a function of irradiation time. In all cases it is noted that a combination of treatment with clay WY and diol produce the greatest photoresistance.

Figure 4:
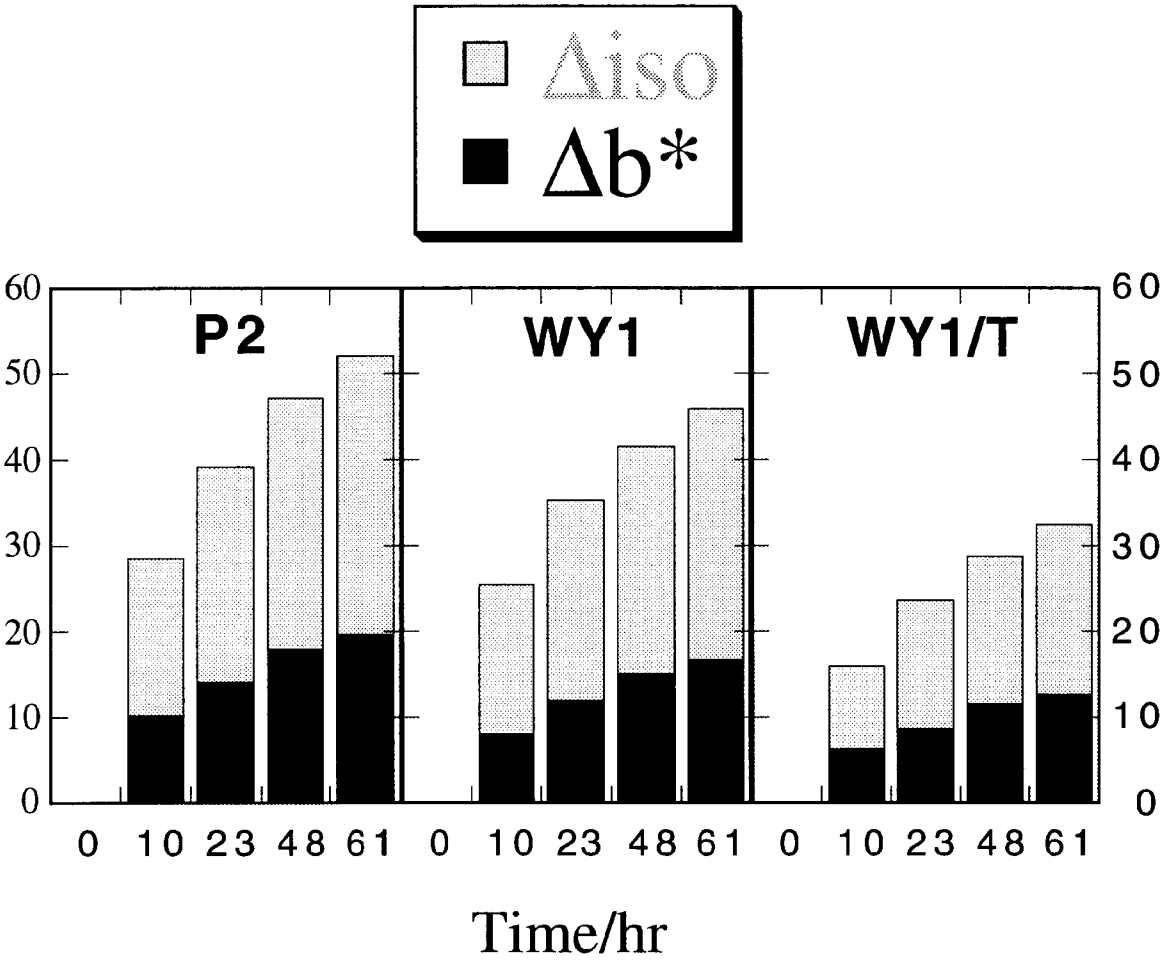
FIG. 4 is a histogram that illustrates the change in optical properties, Δiso and Δb*, between (a) control sample of paper (P2) which does not contain either a clay or zeolite, (b) paper containing natural mined Wyoming montmorillonite (WYl) and (c) paper containing natural mined Wyoming montmorillonite that has been treated with neopentyl glycol (WYl/T).

FIG. 4 shows a comparison of the change in optical properties, Δiso and Δb*, between P2, WYl and WYl/T. FIG. 4 additionally shows the combined difference in Δiso and Δb*, i.e, Δiso+Δb*, between samples P2, WYl and WYl/T.

The aforementioned Wyoming montmorillonite is a Na montmorillonite from Crook County, Wyoming U.S.A. which was obtained from the University of Missouri-Columbia Source Minerals Depository; 101 Geological Sciences Bldg., Columbia, Mo. 65211 U.S.A.

We claim:

1. A process for increasing the photostability of paper made from lignin-rich pulp which comprises treating the pulp or paper in an acidic enviromnent with a diol that is capable of forming a ketal with a carbonyl group in the acidic environment, wherein the diol is converted into the ketal with the carbonyl group in the acidic environment, and whereby said treatment increases the photostability of the paper.

2. The process according to claim 1 wherein the diol is selected from the group consisting of 1,2-diols, 1,3-diols and 1,4-diols.

3. The process according to claim 2, wherein the diol is a 1,2-diol or a 1,3-diol.

4. The process according to claim 2, wherein the diol has a molecular weight above about 76 and below about 1000.

5. The process according to claim 2, wherein the diol is present in about 1–15% by weight of the pulp.

6. The process according to claim 2, wherein the diol is present in about 3–15% by weight of the pulp.

7. The process according to claim 2, wherein the diol is neopentyl glycol.

8. The process according to claim 2, wherein the diol is ethylene glycol.

9. The process according to claim 2, wherein the diol is added to paper, the paper having a water content of less than about 50%, and the diol is in an aqueous solution comprising at least about 10% diol by weight of the solution.

10. The process according to claim 2, wherein the diol is added after the paper has left a header box in a paper-making process.

11. The process according to claim 2, wherein the acidic environment is provided by the presence of an acidic clay or an acidic zeolite in the pulp or paper.

12. The process according to claim 11, wherein the clay or the zeolite is applied to the surface of the paper in an amount of about 0.1–5% by weight of the paper.

13. The process according to claim 11, wherein the clay or the zeolite is incorporated throughout the paper in about 5–25% by weight of the pulp.

14. The process according to claim 11, wherein the clay is kaolin.

15. The process according to claim 11, wherein the clay is montmorillonite.

16. A process for increasing the photostability of paper made from lignin-rich pulp which comprises treating the pulp or paper with montmorillonite and with neopentyl glycol or ethylene glycol, whereby said treatment increases the photostability of the paper.

17. The process according to claim 16, wherein neopentyl glycol or ethylene glycol is present in about 1–15% by weight of the pulp or paper.

18. The process according to claim 16, wherein the montmorillonite is present in about 1–25% by weight of the pulp or paper.

19. Lignin-rich paper that has been treated in an acidic environment with a diol that is capable of forming a ketal. wherein the diol is converted into the ketal with the carbonyl group in the acidic environment, and whereby said treatment increases the photostability of the lignin-rich paper.

20. The lignin-containing paper according to claim 19 wherein the diol is selected from the group consisting of 1,2-diols, 1,3-diols and 1,4-diols.

21. The lignin-containing paper according to claim 20, wherein the acidic environment is provided by the presence of an acidic clay or an acidic zeolite in the paper.

22. The lignin-containing paper according to claim 21, wherein the diol is neopentyl glycol or ethylene glycol.

23. The lignin-containing paper according to claim 21, wherein the acidic clay is montmorillonite.

* * * * *